US007113726B2

(12) United States Patent
Tokumasu et al.

(10) Patent No.: US 7,113,726 B2
(45) Date of Patent: Sep. 26, 2006

(54) CHARGING DEVICE, IMAGE FORMING PROCESS CARTRIDGE, AND IMAGE FORMING APPARATUS INCLUDING THE CHARGING DEVICE

(75) Inventors: Takahiko Tokumasu, Tokyo (JP); Kenji Sugiura, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 378 days.

(21) Appl. No.: 10/686,563

(22) Filed: Oct. 17, 2003

(65) Prior Publication Data

US 2006/0039719 A1 Feb. 23, 2006

(30) Foreign Application Priority Data

Oct. 17, 2002 (JP) ..... 2002-303202

(51) Int. Cl.
*G03G 15/02* (2006.01)

(52) U.S. Cl. ..... 399/176; 399/111

(58) Field of Classification Search ..... 399/107, 399/111, 115, 168, 174, 175, 176, 50
See application file for complete search history.

(56) References Cited

U.S. PATENT DOCUMENTS

| | | | | |
|---|---|---|---|---|
| 4,614,949 | A | 9/1986 | Hakkaku et al. | |
| 5,040,206 | A | 8/1991 | Tokumasu et al. | |
| 5,208,607 | A | 5/1993 | Ohashi et al. | |
| 5,955,228 | A | 9/1999 | Sakai et al. | |
| 6,041,197 | A * | 3/2000 | Kashihara | 399/50 |
| 6,041,209 | A * | 3/2000 | Murata | 399/313 |
| 6,052,549 | A * | 4/2000 | Shimura et al. | 399/176 |
| 6,278,854 | B1 * | 8/2001 | Handa | 399/111 |
| 6,366,751 | B1 | 4/2002 | Shakuto et al. | |
| 6,398,345 | B1 | 6/2002 | Sakai et al. | |
| 6,496,673 | B1 * | 12/2002 | Bessho | 399/175 |
| 6,539,186 | B1 * | 3/2003 | Kitazawa et al. | 399/100 |
| 6,553,199 | B1 * | 4/2003 | Ishiyama et al. | 399/174 |
| 6,560,419 | B1 | 5/2003 | Sugiura | |
| 6,625,409 | B1 | 9/2003 | Shakuto et al. | |
| 6,654,579 | B1 | 11/2003 | Shakuto et al. | |
| 6,801,724 | B1 * | 10/2004 | Matsumoto et al. | 399/38 |
| 2002/0172525 | A1 | 11/2002 | Sugiura | |

FOREIGN PATENT DOCUMENTS

| | | |
|---|---|---|
| JP | 63-7380 | 1/1988 |
| JP | 5-150564 | 6/1993 |
| JP | 5-289441 | 11/1993 |
| JP | 5-289445 | 11/1993 |
| JP | 7-287433 | 10/1995 |
| JP | 10-312098 | 11/1998 |
| JP | 11-15235 | 1/1999 |
| JP | 11-84825 | 3/1999 |
| JP | 2001-83777 | 3/2001 |
| JP | 2002-55512 | 2/2002 |

* cited by examiner

*Primary Examiner*—Hoan Tran
(74) *Attorney, Agent, or Firm*—Oblon, Spivak, McClelland, Maier & Neustadt, P.C.

(57) ABSTRACT

A charging device includes a charging member which is applied with a voltage including an alternating current voltage superimposed on a direct current voltage to charge an image carrier. An equation of "7≦f/v≦17" is satisfied, where "f" is a frequency (Hz) of the alternating current voltage, and "v" is a moving speed (mm/sec) of the image carrier.

29 Claims, 7 Drawing Sheets

CHARGING DEVICE, IMAGE FORMING PROCESS CARTRIDGE, AND IMAGE FORMING APPARATUS INCLUDING THE CHARGING DEVICE

CROSS-REFERENCE TO RELATED APPLICATIONS

The present application claims priority to Japanese Patent Application No. 2002-303202 filed in the Japanese Patent Office on Oct. 17, 2002, the disclosure of which is incorporated herein by reference.

BACKGROUND OF THE INVENTION

1. Field of the Invention

The present invention relates to a charging device for use in an image forming apparatus, such as a copying machine, a facsimile machine, a printer, or other similar image forming apparatuses.

2. Background of the Art

In an electrophotographic image forming apparatus, such as a copying machine, a facsimile machine, a printer, etc., a charging device that charges an image carrier such as a photoreceptor, has mainly performed corona electric discharge. FIG. 1 is a schematic view of an image forming unit of a conventional image forming apparatus including a non-contact type charging device. Arranged around a photoconductive drum 51 are a charger 52, a developing device 53, a transfer device 54, a sheet separation device 55, a cleaning unit 56, and a discharging lamp 57. The charger 52 functioning as a non-contact type charging device performs corona electric discharge.

The charging device that performs corona electric discharge has problems, such as, production of a large amount of ozone. Further, the charging device requires a high-voltage power supply that applies a high voltage in a range of 5 kV to 10 kV to perform corona electric discharge, thereby increasing the cost of the image forming apparatus.

For this reason, a contact type charging device in which a charging member is brought into contact with an image carrier has been proposed, recently. The contact type charging device charges an image carrier without performing corona electric discharge. Therefore, the contact type charging device is free of the above-described problems of the charging device that performs corona electric discharge. However, the contact type charging device has problems, such as an occurrence of an abnormal image such as image tailing, and increase of an abrasion amount of an image carrier. Further, when an alternating current (AC) voltage is used as a charging bias application voltage, the contact type charging device typically has a noise problem. Moreover, because toner and paper powders are rubbed against a surface of an image carrier by a charging member of the charging device, the surface of the image carrier and the charging member are stained.

The technology which addresses the above-described problems is described, for example, in published Japanese patent application No. 10-312098. A charging member is prevented from being stained by toner and paper powders while controlling charging bias voltages applied to an auxiliary charging member and a charging member. In a so-called cleaner-less system, an occurrence of an abnormal image, such as, positive ghost is prevented.

As described above, in an electrophotographic image forming process, a charging device that uniformly charges an image carrier such as a photoreceptor, has mainly performed corona electric discharge. When performing the corona electric discharge, products, such as, ozone and nitrogen oxides, are produced. When high density ozone stays in an image forming apparatus, the ozone oxidizes a surface of a photoreceptor, thereby deteriorating the photosensitivity of the photoreceptor and causing the surface of the photoreceptor to be charged insufficiently. As a result, the quality of an image is deteriorated. Further, the ozone accelerates the deterioration of members other than the photoreceptor, thereby reducing the useful life of the members.

It is considered that nitrogen oxides cause image tailing. It is known that nitrogen oxides are produced by electric discharge. When nitrogen oxides react with moisture in the air, nitric acid is produced. Further, when nitrogen oxides react with metal, metallic nitrate salt is produced. In an electric discharging area, ammonium ion is produced as well as nitrogen oxides. The ammonium ion reacts with nitrogen oxides, and produces a chemical compound. These products are high resistant in a low humidity environment. However, when the products are in a high humidity environment, the products react with moisture in the air and become low resistant. Therefore, when a thin film made of nitric acid or nitrate salt is formed on a surface of a photoreceptor, an abnormal image such as image tailing occurs. The reason for the occurrence of such an abnormal image is that, because nitric acid and nitrate salt absorb moisture and become low resistant, an electrostatic latent image formed on a surface of a photoreceptor is deteriorated.

Further, because nitrogen oxides remain without being disintegrated in the air after electric discharge, chemical compounds produced from nitrogen oxides adhere to a surface of a photoreceptor during a period when the surface of the photoreceptor is not charged, that is, during a period when an image forming process pauses. There is a consideration that the chemical compounds penetrate from a surface of a photoreceptor into its inside with time. The substances adhered on a surface of a photoreceptor are removed by scraping the substances off the surface of the photoreceptor in a cleaning process. However, this removing method typically results in the increase of cost and the deterioration of the photoreceptor.

Recently, a contact type charging device has been used. In the contact type charging device, a charging member in contact with or adjacent to a photoreceptor, charges a photoreceptor. For example, a roller-shaped charging member charges a photoreceptor while the charging member is driven to rotate by the rotation of the photoreceptor. As compared to a charging device that performs corona electric discharge, the contact type charging device produces much less ozone. Further, because the voltage applied from the charging device is relatively low, the cost of a power supply decreases, and designing for electric insulation becomes easy. Moreover, problems caused by ozone are reduced.

For example, published Japanese patent application No. 63-7380 describes a contact type charging device in which a roller-shaped charging member in contact with a photoreceptor charges the photoreceptor while the charging member is driven to rotate by the rotation of the photoreceptor. Because nitrogen oxides are also produced in a charging device in which a charging member is in contact with or adjacent to a photoreceptor, an occurrence of an abnormal image such as image tailing cannot be prevented completely. The occurrence ratio of image tailing has been considered to be higher in an adjacent type charging device in which a charging member is adjacent to a photoreceptor than a contact type charging device in which a charging member contacts a photoreceptor, because a voltage applied from the charging member to the photoreceptor to uniformly charge the photoreceptor needs to be high. However, it has been found that the occurrence ratio of image tailing is substantially equal to each other between the adjacent type contact device and the contact type charging device.

Further, in the contact type charging device, a roller-shaped charging member is generally made of a rubber material. If the contact type charging device is stopped to function for a long period of time, the roller-shaped charging member in contact with a photoreceptor may be deformed. In addition, because rubber tends to absorb moisture, electrical resistance of the rubber tends to vary significantly depending on environmental conditions. Moreover, the rubber needs several kinds of plasticizer and active materials to exert its elasticity and to prevent its deterioration. To disperse conductive colorant in the rubber, dispersion coadjuvant may be used. Specifically, because a surface of a photoreceptor is made of amorphous resins, such as, polycarbonate, and acrylic, it is weak against the plasticizer, the active material, and the dispersion coadjuvant. Moreover, in the contact type charging device, foreign substances may be stuck in a position between a charging member and a photoreceptor, thereby staining the charging member, and resulting in a charging failure. Further, because a roller-shaped charging member directly contacts a photoreceptor, if the charging member is stopped to function for a long period of time, the photoreceptor may be contaminated by the charging member. In this case, an image failure, such as, lateral streak images may occur.

Accordingly, a method for addressing the above-described problems, such as, photoreceptor contamination, and deformation of a roller, has been proposed. In the method, a charging roller is disposed in a non-contact relation to a photoreceptor. When applying a direct current (DC) bias voltage to a surface of a photoreceptor by such a non-contact type charging roller, the potential of the charged surface of the photoreceptor depends on a gap distance between the charging roller and the photoreceptor as well as a charging bias application voltage.

To address a problem, such as, an occurrence of an abnormal image due to the change of the potential of a charged surface of a photoreceptor caused by the change of a gap distance, published Japanese patent application No. 7-287433 describes a technique in which electric discharge is stably performed by providing minute concave and convex portions on a discharging surface of a charging member. With such minute concave and convex portions, even if a gap distance between a charging member and a photoreceptor is changed, the photoreceptor is uniformly charged without occurrence of abnormal images.

However, these minute concave and convex portions may become flattened with time under severe discharging conditions. If the minute concave and convex portions become flattened, desirable effects may not be obtained, and a surface of a photoreceptor may not be uniformly charged over a long period of time. Further, because the range of the minute concave and convex portions of a charging member is limited to uniformly charge the photoreceptor, the process for producing the minute concave and convex portions needs to be strictly controlled. As a result, producing costs for the minute concave and convex portions may increase.

There are two types of method of applying a charging bias to a photoreceptor: (1) a DC voltage is applied to a photoreceptor (hereinafter referred to as a "DC voltage charging"), and (2) a voltage in which an AC voltage is superimposed on a DC voltage is applied to a photoreceptor (hereinafter referred to as a "DC and AC voltage charging"). It is known that a photoreceptor tends to suffer greater damage in an AC voltage charging than in a DC voltage charging. As in the case of the corona electric discharge, products are produced on a photoreceptor due to electric discharge by a charging device. A larger amount of products are produced in the "DC and AC voltage charging" than in the "DC voltage charging". The reason for this is considered that reverse electric discharge (i.e., electric discharge from a photoreceptor to a charging member) occurs between a charging member and a photoreceptor in the "DC and AC voltage charging". Therefore, the number of electric discharging in the "DC and AC voltage charging" is much more than that in the "DC voltage charging". An actual utilization of the "DC voltage charging" is typically difficult due to problems, such as, unevenness of the potential of a charged photoreceptor due to the change of a gap distance, and unstable discharge. Therefore, it is considered to be preferable that the "DC and AC voltage charging" be employed for the non-contact type charging device. However, even in the "DC and AC voltage charging", if a gap distance significantly varies, electric discharge cannot be stably performed, thereby causing abnormal images.

Recently, another method has been proposed in which a charging member is provided opposite to a surface of an image carrier spaced by a minute gap. With this construction, the charging member is prevented from being stained by contacting the surface of the image carrier. Further, the surface of the image carrier is prevented from being deteriorated quickly.

In this construction, if a gap becomes significantly large, streamer discharge typically occurs. In this condition, the surface of the image carrier cannot be uniformly charged, and spot-shaped abnormal images occur on a toner image formed on the image carrier. As a result, image quality is deteriorated. Therefore, streamer discharge is prevented by setting a gap between the surface of the image carrier and the charging member to about 100 μm or less to enhance image quality.

Published Japanese patent application No. 5-150564 describes a technique in which a frequency of an AC voltage superimposed on a DC voltage to be applied to a charging roller is defined with respect to a linear velocity of a photoreceptor. Generally, if spatial frequency of a charging bias voltage is small, uneven density in an image is sensed by the naked eye. The spatial frequency means the number of peaks or valleys of amplitude cycle of an AC voltage applied to a charging roller per a 1 mm width. For example, the spatial frequency in FIG. 2 is 3/mm.

Further, published Japanese patent application No. 11-84825 describes a technique in which an amplitude and a frequency of an AC voltage applied to a photoreceptor when charging the photoreceptor for not forming latent images thereon is set to be lower than those when charging the photoreceptor for forming latent images thereon. Specifically, as illustrated in FIG. 3, the frequency of a charging bias is set to be high at an image portion, and the frequency of a charging bias at a non-image portion is set to be lower than that. The technique described in published Japanese patent application No. 11-84825 is aimed for preventing an occurrence of image tailing. However, when the present inventors carried out experiments while changing frequency, an amount of products causing image tailing did not change as illustrated in FIG. 4.

As described above, in the background techniques, problems, such as, image deterioration caused by image tailing and contamination of a photoreceptor, uneven density in an image, non-uniform charging, unstable electric discharge, and increase of the cost of an apparatus, are not sufficiently solved.

When charging an image carrier, it has been generally considered that a frequency of an AC voltage superimposed on a DC voltage to be applied to a charging member, such as, a charging roller, is preferably high to uniformly charge the image carrier. However, when the frequency is increased, the surface of the image carrier is deteriorated, and a filming phenomenon typically occurs. In the filming phenomenon, a film made of toner and paper powder adheres to a surface of an image carrier. A film portion of the image carrier is not adequately charged, thereby causing abnormal images. In addition, such a filming phenomenon may also occur at a charging member. On the other hand, if a frequency of an AC voltage is low, uneven image density typically occurs in a halftone image and a solid (black) image.

In a filming phenomenon, a surface of an image carrier is deteriorated due to electric discharge and other factors, thereby causing a film made of toner and paper powder to adhere to the surface of the image carrier. When charging an image carrier by a charging roller, it is generally assumed that molecules of the surface of the image carrier are cut by electric discharge and deteriorated. Further, it is assumed that filming is caused by wax added to toner and adhered to the surface of the image carrier. Moreover, it is assumed that filming is caused by the surface of the image carrier damaged by a cleaning blade or a cleaning brush and carrier particles in a developer. However, these assumptions are not confirmed completely by experiment.

Thus, it is desirable to provide a charging device that prevents an occurrence of a filming phenomenon, extends each useful life of an image carrier and a charging member, and provides a high quality image without uneven density, and to provide an image forming process cartridge, and an image forming apparatus including such a charging device.

SUMMARY OF THE INVENTION

According to one aspect of the present invention, a charging device includes a charging member configured to be applied with a voltage including an alternating current voltage superimposed on a direct current voltage to charge an image carrier. An equation of "$7 \leqq f/v \leqq 17$" is satisfied, where "f" is a frequency (Hz) of the alternating current voltage, and "v" is a moving speed (mm/sec) of the image carrier.

According to another aspect of the present invention, an image forming process cartridge for use in a main body of an image forming apparatus includes at least an image carrier configured to carry an image, and a charging member configured to be applied with a voltage including an alternating current voltage superimposed on a direct current voltage to charge the image carrier. An equation of "$7 \leqq f/v \leqq 17$" is satisfied, where "f" is a frequency (Hz) of the alternating current voltage, and "v" is a moving speed (mm/sec) of the image carrier. The image carrier and the charging member are integrally accommodated in the image forming process cartridge, and the image forming process cartridge is detachably attached to the main body of the image forming apparatus.

According to yet another aspect of the present invention, an image forming apparatus includes an image carrier configured to carry an image, and the above-described charging device.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
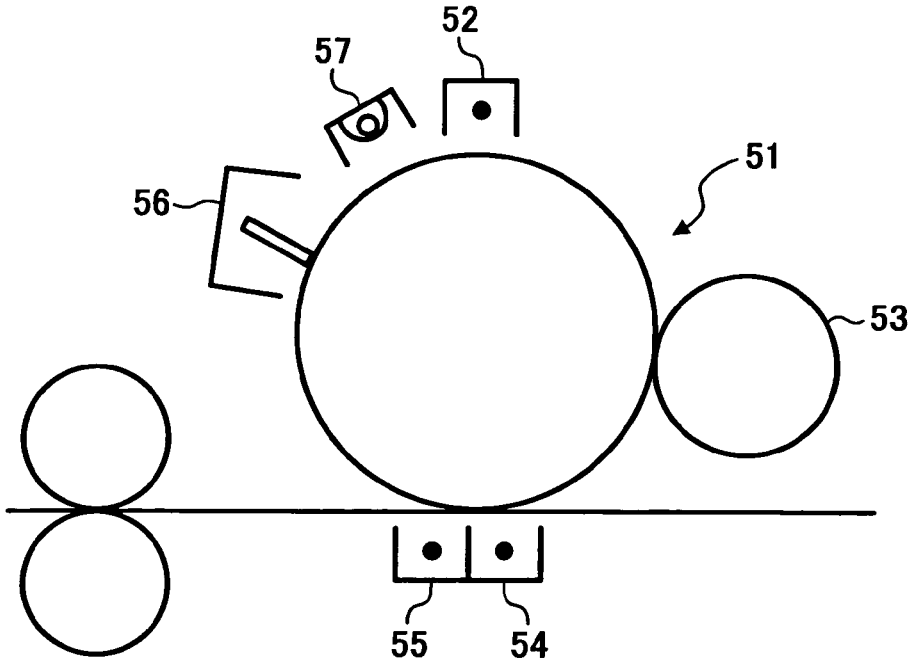
FIG. 1 BACKGROUND ART
FIG. 1 is a schematic view of an image forming unit in a background image forming apparatus including a non-contact type charging device.

Preferred embodiments of the present invention are described in detail referring to the drawings, wherein like reference numerals designate identical or corresponding parts throughout the several views.

Figure 5:
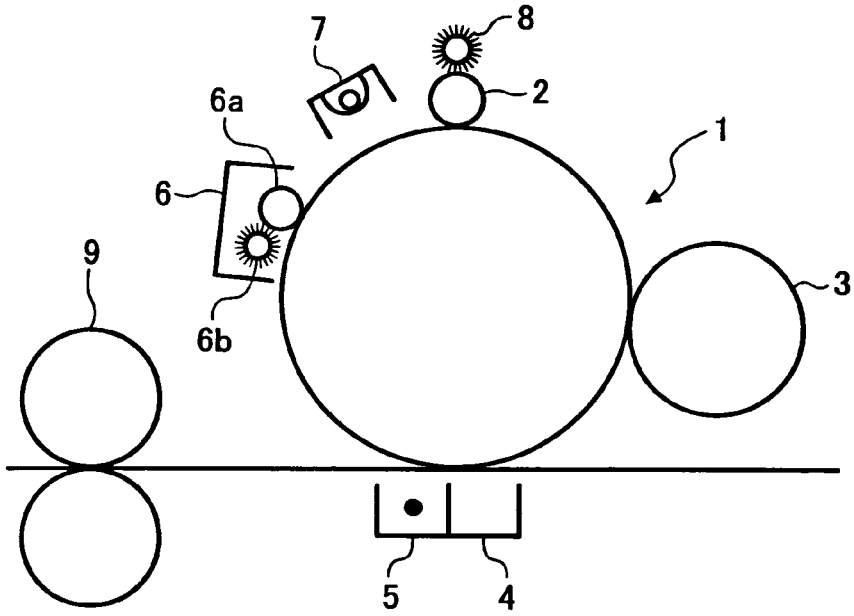
FIG. 5 is a schematic view of an image forming unit of an image forming apparatus including a charging device according to an embodiment of the present invention.

FIG. 5 is a schematic view of an image forming unit of an image forming apparatus including a charging device according to an embodiment of the present invention. Referring to FIG. 5, arranged around a photoconductive drum 1 functioning as an image carrier are a charging roller 2, a developing roller 3, a transfer charger 4, a sheet separation charger 5, a cleaning unit 6, and a discharging lamp 7. A cleaning brush roller 8 is provided on the charging roller 2. A reference numeral 9 indicates a fixing device. As illustrated in FIG. 5, the cleaning unit 6 includes a cleaning roller 6*a*, and a brush roller 6*b* provided to the cleaning roller 6*a*. As an alternative, the cleaning unit 6 may include a cleaning blade like the cleaning unit 56 illustrated in FIG. 1.

Figure 6:
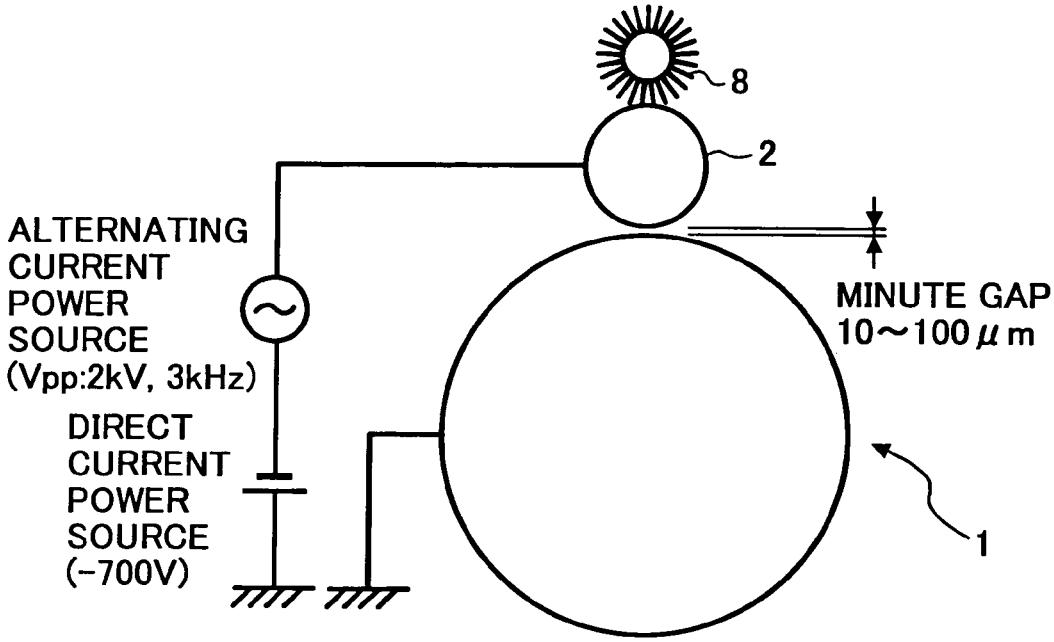
FIG. 6 is an enlarged view of a charging device and a photoconductive drum.

FIG. 6 is an enlarged view of a charging device and the photoconductive drum 1. As illustrated in FIG. 6, the charging roller 2 is disposed opposite to the photoconductive drum 1 spaced by a minute gap. In this embodiment, the distance of the gap is set to be in a range of about 10 μm to about 100 μm. A charging bias in which an AC voltage (e.g., a peak to peak voltage "Vpp": 2 kV, frequency: 3 kHz) is superimposed on a DC voltage (e.g., −700V), is applied to the charging roller 2 from an AC power supply and a DC power supply. In this embodiment, the charging device includes the charging roller 2, the cleaning brush roller 8, the AC power supply, and the DC power supply.

Generally, the rotational direction (i.e., a counter-clockwise direction) of the charging roller 2 is set to be opposite to the rotational direction (i.e., a clockwise direction) of the photoconductive drum 1 by a drive mechanism (not shown) such as gears. However, the rotational direction of the charging roller 2 may be set to be equal to that of the photoconductive drum 1. Further, the rotational speed of the charging roller 2 is generally set to be substantially equal to the linear velocity of the photoconductive drum 1. However, the rotational speed of the charging roller 2 may be higher than the linear velocity of the photoconductive drum 1. If the rotational speed of the charging roller 2 is set to be lower than the linear velocity of the photoconductive drum 1, the photoconductive drum 1 may be charged unstably.

In this embodiment, the cleaning brush roller 8 is provided on the charging roller 2 to remove stains, such as, toner adhered to the charging roller 2. If the charging roller 2 is a contact type charging roller which contacts the photoconductive drum 1, only a DC voltage may be applied to the charging roller 2 as a charging bias. As described above, the charging roller 2 of the present embodiment is a non-contact type charging roller, and a charging bias in which an AC voltage is superimposed on a DC voltage is applied to the charging roller 2.

Figure 7:
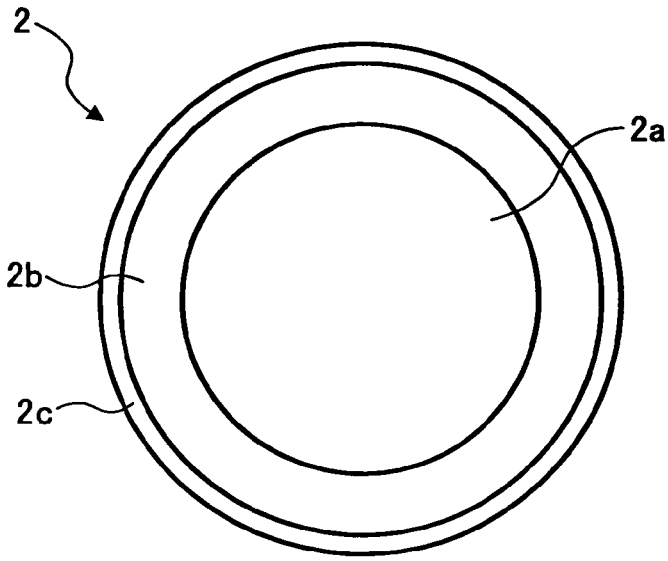
FIG. 7 is a cross sectional view of a charging roller according to the embodiment of the present invention.

FIG. 7 is a cross sectional view of the charging roller 2. As illustrated in FIG. 7, the charging roller 2 includes a cylindrical-shaped conductive core metal 2*a*, a cylindrical-shaped intermediate resistance layer 2*b* fixed onto the core metal 2*a*, and a surface layer 2*c* overlaid on the intermediate resistance layer 2*b*.

The core metal 2*a* is formed from a metallic material having a high rigidity and conductivity such as stainless steel and aluminum, and from a conductive resin having a high rigidity and a volume resistivity of at most about $1\times10^3$ Ω·cm, preferably at most about $1\times10^2$ Ω·cm. In this embodiment, the core metal 2*a* has a diameter in a range of about 4 mm to about 20 mm, and constructs a core shaft of the charging roller 2.

The intermediate resistance layer 2*b* has a volume resistivity in a range of about $10^4$ Ω·cm to about $10^9$ Ω·cm, and has a thickness, for example, in a range of about 1 mm to about 2 mm.

The surface layer 2*c* has a volume resistivity in a range of about $10^6$ Ω·cm to $10^{11}$ Ω·cm. It is preferable that the volume resistivity of the surface layer 2*c* be higher than that of the intermediate resistance layer 2*b*. The thickness of the surface layer 2*c* is, for example, about 10 μm.

Figure 8:
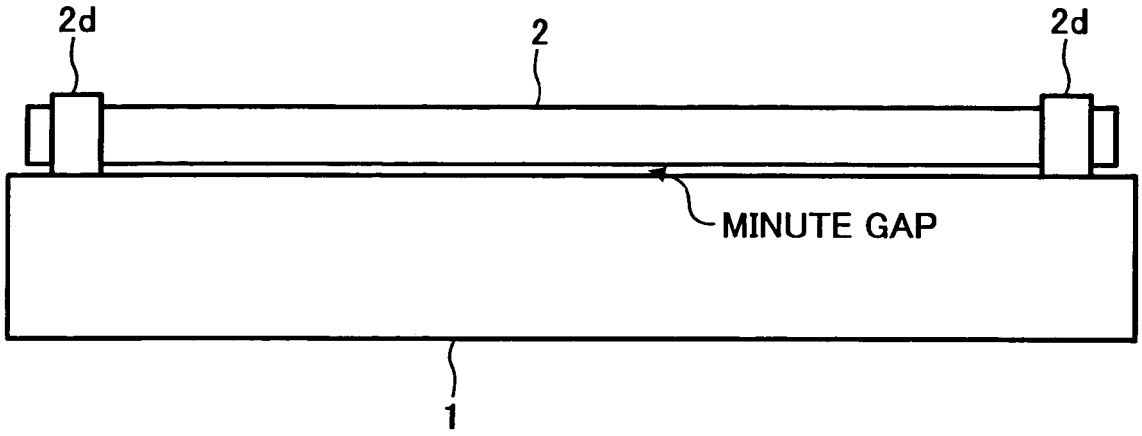
FIG. 8 is a side view of the charging roller and the photoconductive drum.

FIG. 8 is a side view of the charging roller 2 and the photoconductive drum 1. As illustrated in FIG. 8, spacer members 2*d* are wrapped around the circumferential surface of the charging roller 2 at the positions adjacent to both end portions of the charging roller 2 in its axial direction, thereby forming a minute gap between the charging roller 2 and the photoconductive drum 1. In this embodiment, the spacer members 2*d* are formed from tapes. Alternatively, a gap may be formed by using rollers, etc.

Examples of the material for the tapes of the spacer members 2*d* include metals or metal oxides, such as, aluminum, iron, and nickel, and alloyed metals, such as, Fe—Ni alloyed metal, stainless steel, Co—Al alloyed metal, Ni steel, duralumin, Monel metal (trademark), Inconel (trademark), and olefin resins, such as, polyethylene (PE) and polypropylene (PP), and polyester resins, such as, polyethylene terephthalate (PET) and polybutylene terephthalate (PBT), and fluororesins, such as polytetrafluoroethylene (PTFE), tetrafluoroethylene-perfluoroalkyl vinyl ether copolymers (PFA), and fluorinated ethylene propylene resin (FEP), and polyimide resin. It is preferable that the tapes be made of a material having a high toner releasing property so that toner does not fix onto the tapes. If a conductive material is used for the tapes, the tapes are insulated from the photoconductive drum 1 by coating the tapes with an insulation layer or a semi-resistive element layer.

The intermediate resistance layer 2*b* is made of a material in which a conductive agent is dispersed in a base material. Examples of the base material include olefin resins, such as, polyethylene (PE) and polypropylene (PP), styrene resins, such as, polystyrene (PS) and polystyrene copolymers (AS, ABS), and acrylic resins, such as, polymethylmethacrylate (PMMA).

Examples of the conductive agents of the intermediate resistance layer 2*b* include alkali metallic salt, such as, lithium peroxide, perchlorate, such as, sodium perchlorate, and quaternary ammonium salt, such as, tetrabutyl ammonium salt, and ionic conductive agent, such as, polymeric conductive agent, and carbon black, such as, ketjen black, and acetylene black.

The surface layer 2*c* is made of a material in which a conductive agent is dispersed in a base material. Examples of the base material include fluororesin, silicone resin, acrylic resin, polyamide resin, polyester resin, polyvinyl butyral resin, and polyurethane resin. Especially, it is preferable that a material on which toner does not tend to fix be selected.

Examples of the conductive agents of the surface layer 2*c* include carbon black, such as, ketjen black and acetylene black, and an electronic conduction conductive agent made of metal oxide, such as, indium oxide, and tin oxide. The materials for the charging roller 2 are not limited to the above-described materials.

As described above, if spatial frequency of an AC voltage applied to a charging roller is small, uneven density in a developed image is sensed by the naked eye. As spatial frequency of an AC voltage applied to a charging roller decreases, the naked eye is more sensitive to uneven density in an image. In contrast, as spatial frequency of an AC voltage applied to a charging roller increases, the naked eye is less sensitive to uneven density in an image. Specifically, if spatial frequency is 7/mm or more, uneven density in an image is less sensed, and if spatial frequency is 9/mm or more, uneven density in an image is hardly sensed. Therefore, in this embodiment, the lower limit of spatial frequency is set to 7/mm, and preferably 9/mm in view of the visual sensitivity.

The upper limit of a frequency of an AC voltage applied to a charging roller is determined in view of an occurrence of filming. The present inventors carried out experiments to find a relationship between an occurrence of filming and the frequency under the following conditions:

(1) linear velocity of an imager carrier: 185 mm/sec, and (2) a frequency of an AC voltage applied to a charging roller: 2000 Hz and 4500 Hz.

According to the experimental results, filming did not occur when the frequency was 2000 Hz, but filming occurred when the frequency was 4500 Hz. When the frequency was 2000 Hz, spatial frequency was about 10.8 /mm, and when the frequency was 4500 Hz, spatial frequency was about 24.3/mm.

Further, the present inventors carried out another experiments under the following conditions:

(1) linear velocity of an imager carrier: 141 mm/sec, and (2) a frequency of an AC voltage applied to a charging roller: 2000 Hz and 2500 Hz.

According to the experimental results, filming did not occur when the frequency was 2000 Hz, but filming occurred when the frequency was 2500 Hz. When the frequency was 2000 Hz, spatial frequency was about 14.2/mm, and when the frequency was 2500 Hz, spatial frequency was about 17.7/mm.

According to these results of the experiments, it was found to be preferable that the upper limit of the spatial frequency be about 17.7/mm, more preferably about 17/mm for margin, still more preferably about 15/mm to surely control the filming.

Referring to FIG. 6, when a charging bias (frequency: 3 kHz) is applied to the charging roller 2 under the condition that the linear velocity of the photoconductive drum 1 is about 200 mm/sec, the spatial frequency becomes 15/mm.

In this embodiment, as described above, spatial frequency of an AC voltage applied to the charging roller 2 is set to be from about 7/mm to about 17/mm, and preferably from about 9/mm to about 15/mm. With this setting, a filming phenomenon can be prevented from occurring at the photoconductive drum 1 and the charging roller 2, thereby avoiding an abnormal image and uneven density in an image. Further, the decrease of useful time of the photoconductive drum 1 and the charging roller 2 caused by a filming phenomenon can be prevented.

Figure 2:
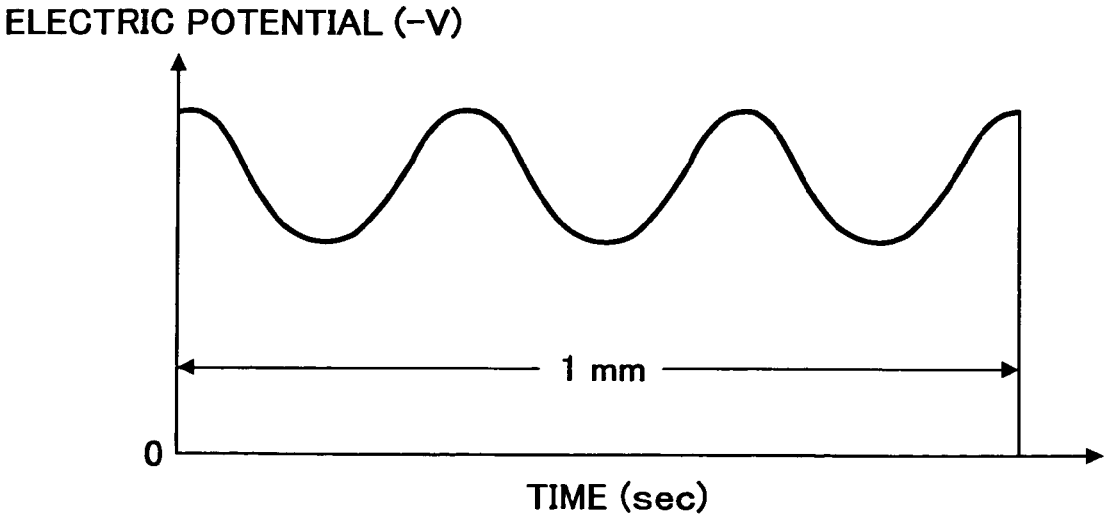
FIG. 2 is a graph showing spatial frequency of an alternating current voltage applied to a charging roller.
Figure 3:
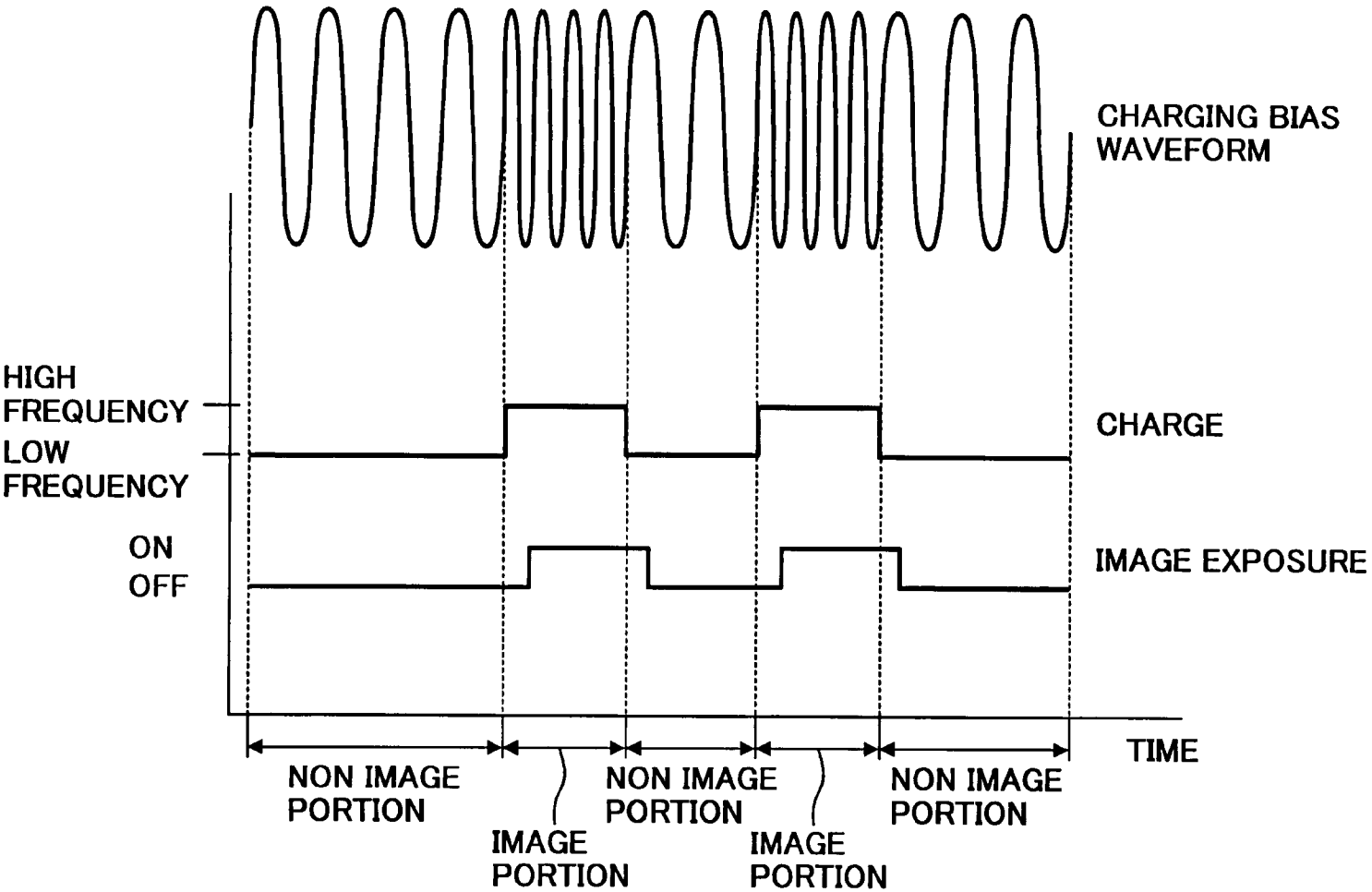
FIG. 3 BACKGROUND ART
FIG. 3 is a graph showing a waveform of a charging bias according to a background art.
Figure 4:
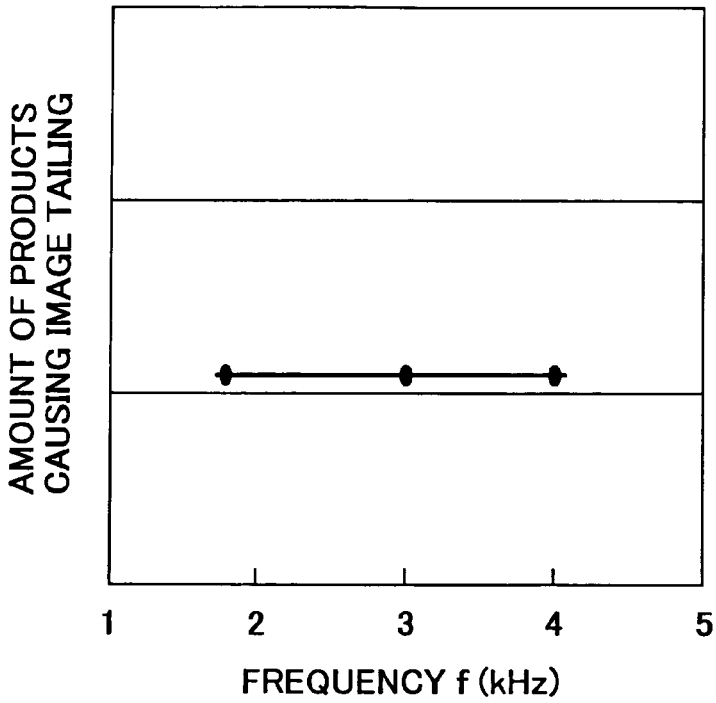
FIG. 4 is a graph showing a relationship between an amount of products causing image tailing and a frequency of an alternating current voltage applied to a photoreceptor based on experimental results.

Although a peak-to-peak voltage (Vpp) of the AC voltage is not illustrated in FIG. 2, according to claim 2 in published Japanese patent application No. 10-312098, it is described that a peak-to-peak voltage of an AC voltage to be applied to a charging member is set to a voltage less than two times a charge start threshold voltage (Vth). On the other hand, in the present embodiment, a peak-to-peak voltage (Vpp) of the AC voltage is set to a voltage twice or more a charge start threshold voltage (Vth) so that electric discharge constantly occurs at peak and valley portions of the AC voltage applied to the charging roller 2.

Although the spatial frequency of the AC voltage applied to the charging roller 2 is set to the above-described range in the present embodiment, the above-described range need not be applied when the charging roller 2 charges an area of the surface of the photoconductive drum 1 other than its image forming area. From the viewpoint of the prevention of a filming phenomenon, it is preferable that the spatial frequency of the AC voltage applied to the charging roller 2 be relatively low. However, if the potential of the charged photoconductive drum 1 is significantly low, toner may be adhered to the photoconductive drum 1. Therefore, it is necessary that the potential of the charged photoconductive drum 1 does not become significantly low.

Figure 9:
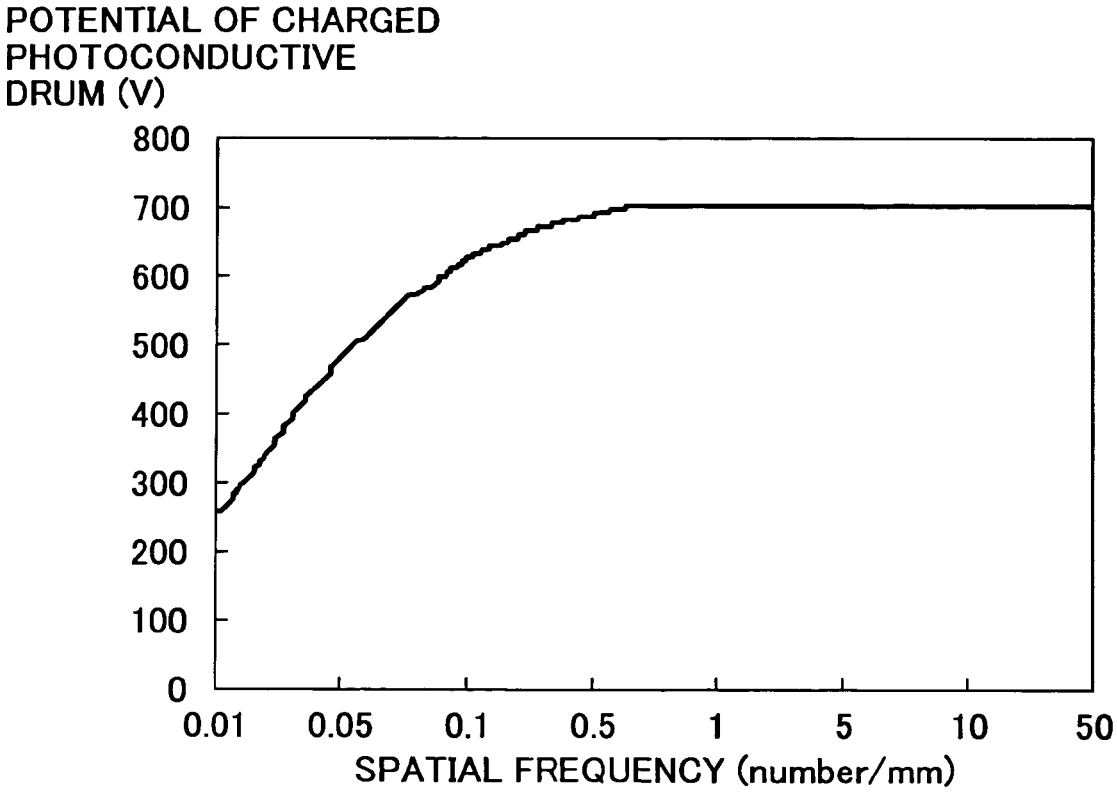
FIG. 9 is a graph showing a relationship between a potential of a charged photoconductive drum and spatial frequency of an AC voltage applied to the charging roller based on experimental results.

According to the results of the experiments performed by the present inventors, when the spatial frequency of the AC voltage applied to the charging roller 2 was about 0.5/mm, the potential of the charged photoconductive drum 1 did not fall. Accordingly, the lower limit of the spatial frequency of the AC voltage applied to the charging roller 2 when charging an area of the surface of the photoconductive drum 1 other than its image forming area, is set to about 0.5/mm in this embodiment. FIG. 9 is a graph showing a relationship between the potential of the charged photoconductive drum 1 and the spatial frequency of the AC voltage applied to the charging roller 2 based on experimental results. As seen from FIG. 9, the potential of the charged photoconductive drum 1 is substantially constant when the spatial frequency is 0.5/mm or more. Further, in this embodiment, the upper limit of the spatial frequency of the AC voltage applied to the charging roller 2 when charging an area of the surface of the photoconductive drum 1 other than its image forming area, is set to about 7/mm which equals the lower limit of the spatial frequency of the AC voltage applied to the charging roller 2 when charging an image forming area of the photoconductive drum 1. By setting the spatial frequency of the AC voltage applied to the charging roller 2 when charging an area of the surface of the photoconductive drum 1 other than its image forming area, to from about 0.5/mm to about 7/mm, an occurrence of a filming phenomenon at a non-image forming area of the photoconductive drum 1 can be surely avoided.

Figure 10:
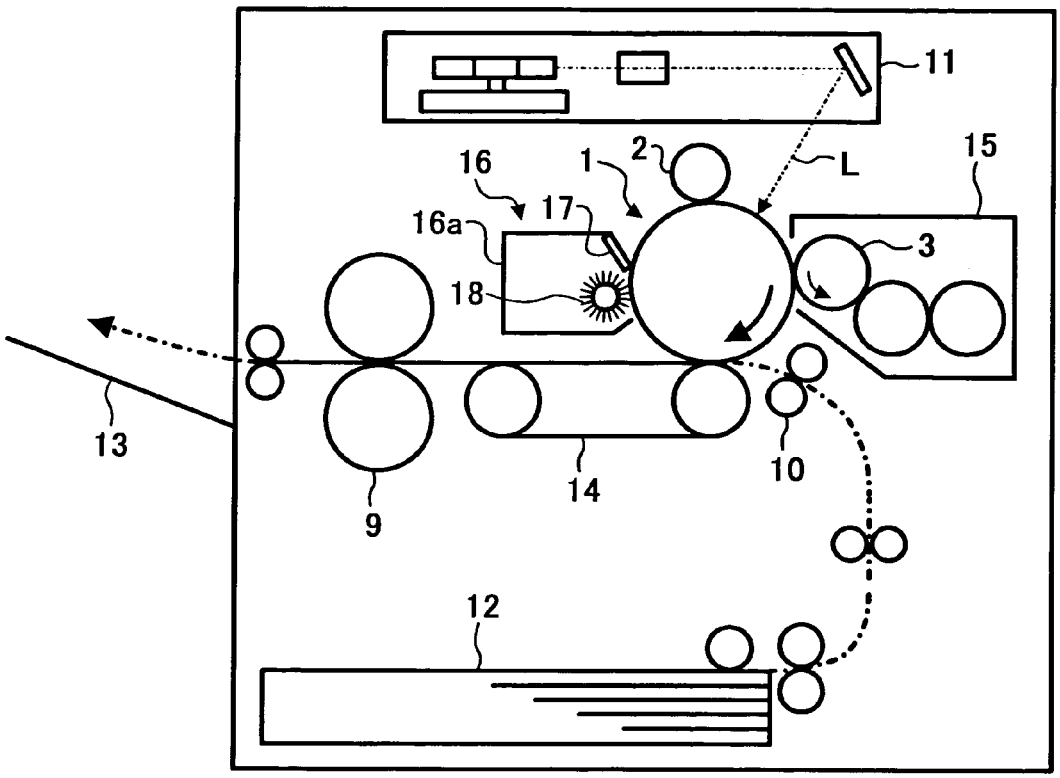
FIG. 10 is a cross section of an image forming apparatus according to the embodiment of the present invention.

FIG. 10 is a cross section of an image forming apparatus according to the embodiment of the present invention. Referring to FIG. 10, an image forming unit having a construction similar to that of the image forming unit described referring to FIG. 5 is disposed at a substantially center part of a main body of the image forming apparatus. The image forming unit of FIG. 10 includes a cleaning unit 16 in place of the cleaning unit 6 in FIG. 5, and a transfer/conveyance belt unit 14 in place of the transfer charger 4 and the sheet separation charger 5 illustrated in FIG. 5. The members of the image forming unit of FIG. 10 having substantially same functions as those of the image forming unit of FIG. 5 are indicated by the same reference numerals. In the image forming unit of FIG. 10, illustrations of the cleaning brush roller 8 and the discharging lamp 7 are omitted.

A laser writing unit 11 as an example of an exposure device is disposed at the upper part of the image forming apparatus of FIG. 10, and a cassette 12 as a sheet feeding device is disposed at the lower part thereof. Further, a pair of registration rollers 10 is situated diagonally to the lower-right of the photoconductive drum 1. Moreover, a sheet discharging tray 13 is provided on the left-hand side surface of the image forming apparatus in FIG. 10.

As in the case of the image forming unit of FIG. 5, a charging bias in which an AC voltage is superimposed on a DC voltage is applied to the charging roller 2 in the image forming apparatus of FIG. 10. With regard to a frequency of an AC voltage of a charging bias, it is similar to that described referring to FIGS. 5 through 8. Therefore, its description is omitted here.

The image forming apparatus of the present embodiment includes the photoconductive drum 1 serving as an image carrier. The photoconductive drum 1 is formed from a drum having a photosensitive layer overlaid with the outer circumferential surface of a cylindrical conductive base. In place of a drum-shaped image carrier, an endless-belt-shaped image carrier spanned around a plurality of rollers to be driven to rotate, may be used.

The photoconductive drum 1 is driven to rotate in the clockwise direction indicated by the arrow in FIG. 10 at the time of an image forming operation. At this time, the charging roller 2 charges the surface of the photoconductive drum 1 with a predetermined polarity. The laser writing unit 11 irradiates the surface of the photoconductive drum 1 with an optically modulated laser light (L), thereby forming an electrostatic latent image on the photoconductive drum 1. In this embodiment, an absolute value of the surface potential of the photoconductive drum 1 exposed to the laser light (L) decreases, thereby forming an electrostatic latent image portion (i.e., image portion). Further, a portion of the surface of the photoconductive drum 1 which is not exposed to the laser light (L) and where an absolute value of the surface potential of the photoconductive drum 1 remains high becomes a background portion (i.e., non-image portion). Subsequently, the electrostatic latent image is developed with toner which has been charged with a predetermined polarity by the developing roller 3 and is visualized as a toner image. In place of the laser writing unit 11 functioning as an exposure device, an exposure device using an LED system or an analogue type exposure device may be used.

A transfer sheet as a recording medium is fed from the sheet feeding cassette 12, and is conveyed to a transfer region where the photoconductive drum 1 and the transfer/conveyance belt unit 14 face each other by the registration rollers 10 at an appropriate timing. Subsequently, the toner image formed on the photoconductive drum 1 is electrostatically transferred onto the transfer sheet. The transfer sheet having the transferred toner image is conveyed to the fixing device 9 by the transfer/conveyance belt unit 14. The fixing device 9 fixes the toner image on the transfer sheet under the influence of heat and pressure. The transfer sheet having the fixed toner image is discharged and stacked on the sheet discharging tray 13. After the toner image is transferred from the photoconductive drum 1 to the transfer sheet, the cleaning unit 16 removes residual toner remaining on the surface of the photoconductive drum 1.

A developing device 15 contains a dry type developer in a developing case. The developing roller 3 in the developing device 15 carries and conveys the developer. The developer may be, for example, a two-component developer including toner and carrier or a one-component developer including toner. Alternatively, a developing device using a liquid type developer may be used in the image forming apparatus. When the developing roller 3 is driven to rotate in a counterclockwise direction as indicated by an arrow in FIG. 10, the developer is carried on the circumferential surface of the developing roller 3 and conveyed to a developing region where the developing roller 3 faces the photoconductive drum 1. The toner of the developer is electrostatically transferred from the developing roller 3 onto an electrostatic latent image on the photoconductive drum 1. Thus, the electrostatic latent image is visualized as a toner image.

The transfer/conveyance belt unit 14 includes a transfer roller (not shown) that applies a transfer voltage having a polarity opposite to that of charged toner on the photoconductive drum 1. Instead of the transfer roller, a transfer brush, a transfer blade, or a transfer member formed from a corona discharging member including a corona wire may be used. In this embodiment, a toner image on the photoconductive drum 1 is directly transferred to a transfer sheet. Alternatively, a toner image on the photoconductive drum 1 may be transferred to a transfer sheet via an intermediate transfer element.

The cleaning unit 16 includes cleaning members, such as, a cleaning blade 17 and a fur brush 18. The cleaning blade 17 is supported by a cleaning case 16*a* at its base end portion, and the fur brush 18 is rotatably supported by the cleaning case 16*a*. The cleaning blade 17 and the fur brush 18 contact the surface of the photoconductive drum 1, and remove residual toner remaining on the surface of the photoconductive drum 1. Any cleaning member other than a cleaning blade and a fur brush may also be used. As an alternative cleaning method, residual toner remaining on the surface of the photoconductive drum 1 may be removed by the transfer device 15 without using the cleaning unit 16.

Figure 11:
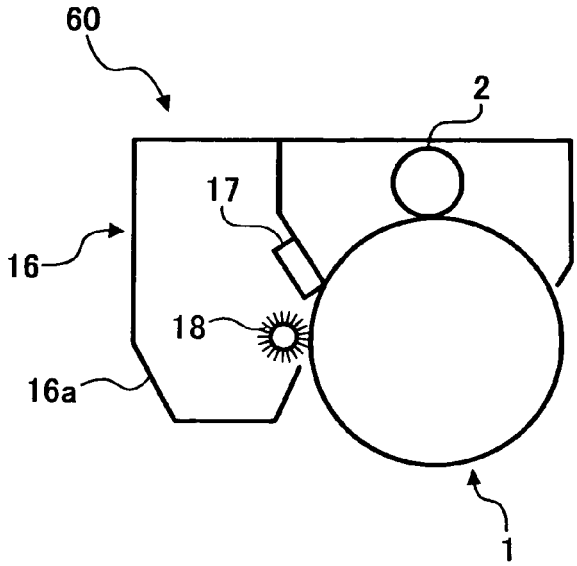
FIG. 11 is a schematic cross section of an image forming process cartridge according to the embodiment of the present invention.

In the image forming apparatus according to the present embodiment, as illustrated in FIG. 11, the charging roller 2, the cleaning unit 16, and the photoconductive drum 1 are integrally assembled in an image forming process cartridge 60. Alternatively, at least the charging roller 2 and the photoconductive drum 1 may be integrally assembled in the image forming process cartridge 60. The image forming process cartridge 60 is detachably attached to the main body of the image forming apparatus for easy maintenance. The image forming process cartridge 60 is replaced with a new one at the end of its useful life.

The charging roller 2 and the photoconductive drum 1 are integrally assembled in the image forming process cartridge 60 under the condition that a minute gap is kept constant between the charging roller 2 and the photoconductive drum 1. Further, the image forming process cartridge 60 is constructed to be detachably attached to the main body of the image forming apparatus while maintaining the minute gap formed between the charging roller 2 and the photoconductive drum 1. In this construction, the gap between the charging roller 2 and the photoconductive drum 1 can be prevented from changing when the image forming process cartridge 60 is attached and detached to/from the main body of the image forming apparatus. The charging roller 2 and the photoconductive drum 1 may be detachably attached to the main body of the image forming apparatus, independently. However, in this case, the gap between the charging roller 2 and the photoconductive drum 1 may be changed when the charging roller 2 and the photoconductive drum 1 are attached and detached to/from the main body of the image forming apparatus. As a result, the photoconductive drum 1 may not be uniformly charged by the charging roller 2.

As described above, the image forming process cartridge 60 accommodates the cleaning unit 16 in addition to the charging roller 2 and the photoconductive drum 1. In the cleaning unit 16, the cleaning blade 17 and the fur brush 18 are supported by the cleaning case 16*a* that constructs a part of the image forming process cartridge 60. The cleaning blade 17 and the fur brush 18 function as contact members that contact the photoconductive drum 1 to remove residual toner remaining on the surface of the photoconductive drum 1. In this construction, the cleaning blade 17 and the fur brush 18 are unitarily attached and detached to/from the main body of the image forming apparatus when the image forming process cartridge 60 is attached and detached to/from the main body of the image forming apparatus.

These contact members, that is, the cleaning blade 17 and the fur brush 18 in this embodiment, may be attached and detached to/from the main body of the image forming apparatus separately from the charging roller 2. However, in this case, if these contact members press against the photoconductive drum 1 when the cleaning blade 17 and the fur brush 18 are attached and detached to/from the main body of the image forming apparatus, the minute gap between the charging roller 2 and the photoconductive drum 1 changes. In contrast, in the present embodiment, because the contact members (the cleaning blade 17 and the fur brush 18), the charging roller 2, and the photoconductive drum 1 are unitarily attached and detached to/from the main body of the image forming apparatus, the contact members do not move relatively to the photoconductive drum 1. Thus, the minute gap between the charging roller 2 and the photoconductive drum 1 may not be significantly changed.

If the surface of the photoconductive drum 1 is not uniform, that is, if the surface of the photoconductive drum 1 includes concave and convex portions, the minute gap between the charging roller 2 and the photoconductive drum 1 tends to change when the photoconductive drum 1 rotates. Therefore, it is preferable that the photoconductive drum 1 include a surface layer made of amorphous-silicon to have a smooth and uniform surface. With such a surface layer, a minute gap between the charging roller 2 and the photoconductive drum 1 can be effectively prevented from changing when the photoconductive drum 1 rotates. Further, durability of the photoconductive drum 1 can be increased by providing the surface layer made of amorphous-silicon which is superior in hardness with the photoconductive drum 1. Therefore, a high quality image can be stably obtained over time by using the photoconductive drum 1 including a surface layer made of amorphous-silicon, and the charging device almost free of a filming phenomenon.

As an alternative, the photoconductive drum 1 may include a surface layer in which a filler is dispersed. For example, an alumina powder having a particle diameter of about 0.1 μm or less may be dispersed in the surface layer of the photoconductive drum 1. With such a surface layer, surface hardness of the photoconductive drum 1 can be increased, thereby enhancing abrasion resistance of the photoconductive drum 1. As a result, a useful life of the photoconductive drum 1 can be significantly extended. Therefore, a high quality image can be stably obtained over time by using the photoconductive drum 1 including a surface layer in which a filler is dispersed, and the charging device almost free of a filming phenomenon.

Figure 12:
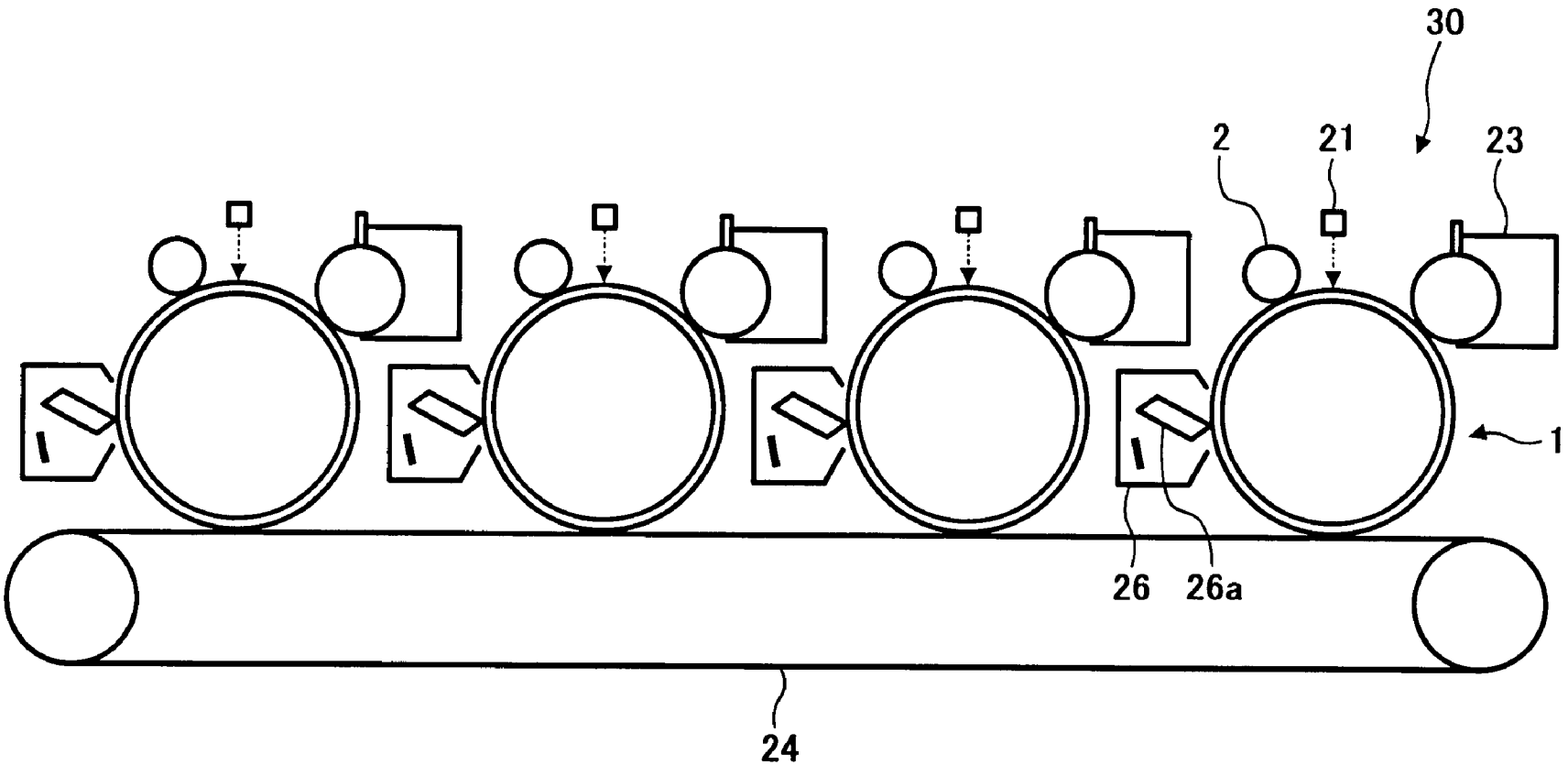
FIG. 12 is a schematic cross section of a part of a tandem type full-color image forming apparatus according to an alternative embodiment of the present invention.

The image forming apparatus of FIG. 10 may be a color image forming apparatus. An example of a part of the color image forming apparatus is illustrated in FIG. 12. The color image forming apparatus of FIG. 12 is a so-called tandem type full-color image forming apparatus that includes four image forming units 30 that form toner images of different colors (e.g., yellow, cyan, magenta, and black toner images), respectively. Four image forming units 30 are arranged side by side above and along an upper and substantially horizontal run of a transfer/conveyance belt unit 24. The members of each of the image forming unit 30 of FIG. 12 having substantially the same functions as those of the image forming unit of FIG. 10 are indicated by the same reference numerals. Further, the four image forming units 30 are substantially the same except for the color of toner used therein, therefore the construction of one of the image forming units 30 will be described below.

Arranged around the photoconductive drum 1 are the charging roller 2, a developing device 23, and a cleaning unit 26. As in the case of the image forming unit of FIG. 5, the cleaning brush roller 8 is provided onto the charging roller 2 in the image forming unit 30, but the illustration of the cleaning brush roller 8 is omitted in FIG. 12. The cleaning unit 26 includes a cleaning blade 26*a*. Further, a light-emitting diode (LED) 21 functioning as a solid light writing device is provided in each of the image forming units 30.

As described above, a charging bias in which an AC voltage is superimposed on a DC voltage is applied to the charging roller 2. Because the condition of a frequency of an AC voltage of the charging bias is like one described above, its description is omitted here.

In the tandem type full-color image forming apparatus of FIG. 12, for example, yellow, cyan, magenta, and black toner images are formed in the image forming units 30, respectively, in order from left to right hand side in FIG. 12, and are sequentially transferred from the photoconductive drums 1 onto a transfer sheet conveyed by the transfer/conveyance belt unit 24, and are each superimposed thereon. As a result, a superimposed full-color image is formed on the transfer sheet. When forming a mono-color (i.e., black) image, an image is formed in one of the image forming units 30 using a black toner.

As described above, according to the embodiments of the present invention, the charging roller 2 is disposed opposite to the photoconductive drum 1 spaced by a minute gap. Due to this construction, an occurrence of a filming phenomenon is obviated, thus preventing the decrease of useful life of the charging roller 2 and the photoconductive drum 1.

Further, in the above-described image forming apparatus according to the present embodiments, deterioration of the charging roller 2 with time can be controlled while preventing an occurrence of a filming phenomenon. Thus, an occurrence of an abnormal image caused by a deteriorated charging roller 2 can be prevented.

The present invention has been described with respect to the exemplary embodiments illustrated in the figures. However, the present invention is not limited to these embodiments and may be practiced otherwise.

In the above-described embodiments, the charging roller 2 is used as a charging member. In place of the charging roller 2, any charging member, such as, a charging brush may also be used. In the embodiments, the rotatable roller-shaped charging member (i.e., the charging roller 2) can be easily cleaned by the cleaning brush roller 8, thereby preventing an occurrence of a filming phenomenon at the charging member.

Further, in place of the tandem type color image forming apparatus, a revolver type color image forming apparatus that includes a plurality of (e.g., four) developing devices around one image carrier may also be used as a full-color image forming apparatus.

The values of the linear velocity of the photoconductive drum 1 and the frequency of the AC voltage of the charging bias described in the above-described embodiments are one of non-limiting examples, and not limited thereto.

Numerous additional modifications and variations of the present invention are possible in light of the above teachings. It is therefore understood that within the scope of the appended claims, the present invention may be practiced other than as specifically described herein.

What is claimed:

1. A charging device comprising:

a charging member configured to be applied with a voltage wherein an alternating current voltage is superimposed on a direct current voltage to charge an image carrier, wherein a following relationship is satisfied:

$$7 \leqq f/v \leqq 17,$$

"f" being a frequency (Hz) of the alternating current voltage, and "v" being a moving speed (mm/sec) of the image carrier, the frequency of the alternating current voltage being in a range between 2000 to 4500 Hz.

2. The charging device according to claim 1, wherein a following relationship is further satisfied:

$$9 \leqq f/v \leqq 15.$$

3. The charging device according to claim 2, wherein the relationship $9 \leqq f/v \leqq 15$ is satisfied at least when the charging member charges an image forming area of the image carrier.

4. The charging device according to claim 2, wherein a following relationship is satisfied when the charging member charges an area of the image carrier other than an image forming area of the image carrier:

$$0.5 \leqq f/v \leqq 7.$$

5. The charging device according to claim 1, wherein the relationship $7 \leqq f/v \leqq 17$ is satisfied at least when the charging member charges an image forming area of the image carrier.

6. The charging device according to claim 1, wherein a following relationship is satisfied when the charging member charges an area of the image carrier other than an image forming area of the image carrier:

$$0.5 \leqq f/v \leqq 7.$$

7. The charging device according to claim 1, wherein the charging member is disposed opposite to the image carrier spaced by a minute gap.

8. The charging device according to claim 1, wherein the charging member comprises a rotatable charging roller.

9. An image forming process cartridge for use in a main body of an image forming apparatus, comprising at least:

an image carrier configured to carry an image; and a charging member configured to be applied with a voltage wherein an alternating current voltage is superimposed on a direct current voltage to charge the image carrier, wherein a following relationship is satisfied when the charging member charges an image forming area of the image carrier:

$$7 \leqq f/v \leqq 17,$$

"f" being a frequency (Hz) of the alternating current voltage, and "v" being a moving speed (mm/sec) of the image carrier, wherein a following relationship is satisfied when the charging member charges an area of the image carrier other than the image forming area of the image carrier, $$0.5 \leqq f/v \leqq 7, \text{ and}$$

wherein the image carrier and the charging member are integrally accommodated in the image forming process cartridge, and the image forming process cartridge is detachably attached to the main body of the image forming apparatus.

10. The image forming process cartridge according to claim 9, wherein a following relationship is further satisfied:

$$9 \leqq f/v \leqq 15.$$

11. The image forming process cartridge according to claim 10, wherein the relationship $9 \leqq f/v \leqq 15$ is satisfied at least when the charging member charges an image forming area of the image carrier.

12. The image forming process cartridge according to claim 9, wherein the charging member is disposed opposite to the image carrier spaced by a minute gap.

13. The image forming process cartridge according to claim 9, wherein the charging member comprises a rotatable charging roller.

14. The image forming process cartridge according to claim 9, further comprising:

a cleaning member configured to clean the charging member; and at least one contact member in contact with a surface of the image carrier, wherein the cleaning member and the at least one contact member are further integrally accommodated in the image forming process cartridge.

15. The image forming process cartridge according to claim 9, wherein the image carrier comprises a photoreceptor that includes a surface layer made of amorphous-silicon.

16. The image forming process cartridge according to claim 9, wherein the image carrier comprises a photoreceptor that includes a surface layer in which filler is dispersed.

17. An image forming apparatus comprising:

an image carrier configured to carry an image; and a charging device comprising:

a charging member configured to be applied with a voltage wherein an alternating current voltage is superimposed on a direct current voltage to charge the image carrier, wherein a following relationship is satisfied when the charging member charges an image forming area of the image carrier:

$$7 \leqq f/v \leqq 17,$$

"f" being a frequency (Hz) of the alternating current voltage, and "v" being a moving speed (mm/sec) of the image carrier, and wherein a following relationship is satisfied when the charging member charges an area of the image carrier other than the image forming area of the image carrier:

$$0.5 \leqq f/v \leqq 7.$$

18. The image forming apparatus according to claim 17, wherein a following relationship is further satisfied:

$$9 \leqq f/v \leqq 15.$$

19. The image forming apparatus according to claim 18, wherein the relationship 9 (f/v (15 (2) is satisfied at least when the charging member charges an image forming area of the image carrier.

20. The image forming apparatus according to claim 17, wherein the charging member is disposed opposite to the image carrier spaced by a minute gap.

21. The image forming apparatus according to claim 17, wherein the charging member comprises a rotatable charging roller.

22. The image forming apparatus according to claim 17, further comprising:

a cleaning member configured to clean the charging member; and at least one contact member in contact with a surface of the image carrier.

23. The image forming apparatus according to claim 17, wherein the image carrier comprises a photoreceptor that includes a surface layer made of amorphous-silicon.

24. The image forming apparatus according to claim 17, wherein the image carrier comprises a photoreceptor that includes a surface layer in which filler is dispersed.

25. An image forming process cartridge for use in a main body of an image forming apparatus, comprising at least:

image carrying means for carrying an image; and charging means for charging the image carrying means, the charging means being applied with a voltage wherein an alternating current voltage is superimposed on a direct current voltage, wherein a following relationship is satisfied when the charging member charges an image forming area of the image carrier:

$$7 \leqq f/v \leqq 17,$$

"f" being a frequency (Hz) of the alternating current voltage, and "v" being a moving speed (mm/sec) of the image carrying means, wherein a following relationship is satisfied when the charging member charges an area of the image carrier other than the image forming area of the image carrier, $0.5 \leqq f/v \leqq 7$, and wherein the image carrying means and the charging means are integrally accommodated in the image forming process cartridge, and the image forming process cartridge is detachably attached to the main body of the image forming apparatus.

26. The image forming process cartridge according to claim 25, further comprising:

first cleaning means for cleaning the charging means; and second cleaning means for cleaning a surface of the image carrying means, wherein the first cleaning means and the second cleaning means are further integrally accommodated in the image forming process cartridge.

27. An image forming apparatus comprising:

image carrying means for carrying an image; and charging means for charging the image carrying means, the charging means being applied with a voltage wherein an alternating current voltage is superimposed on a direct current voltage, wherein a following relationship is satisfied when the charging member charges an image forming area of the image carrier:

$7 \leqq f/v \leqq 17$,

"f" being a frequency (Hz) of the alternating current voltage, and "v" being a moving speed (mm/sec) of the image carrying means, and wherein a following relationship is satisfied when the charging member charges an area of the image carrier other than the image forming area of the image carrier, $0.5 \leqq f/v \leqq 7$.

28. The image forming apparatus according to claim 27, further comprising:

first cleaning means for cleaning the charging means; and second cleaning means for cleaning a surface of the image carrying means.

29. A charging device comprising:

a charging member configured to be applied with a voltage wherein an alternating current voltage is superimposed on a direct current voltage to charge an image carrier, wherein a following relationship is satisfied when the charging member charges an image forming area of the image carrier:

$7 \leqq f/v \leqq 17$,

"f" being a frequency (Hz) of the alternating current voltage, and "v" being a moving speed (mm/sec) of the image carrier, and wherein a following relationship is satisfied when the charging member charges an area of the image carrier other than the image forming area, $0.5 \leqq f/v \leqq 7$.

* * * * *